US006666930B2

(12) United States Patent
Aoyama et al.

(10) Patent No.: US 6,666,930 B2
(45) Date of Patent: Dec. 23, 2003

(54) FEPT MAGNET AND MANUFACTURING METHOD THEREOF

(75) Inventors: Hitoshi Aoyama, Tokai (JP); Yoshinobu Honkura, Tokai (JP); Takumi Asano, Tokai (JP)

(73) Assignee: Aichi Steel Corporation, Tokai (JP)

( * ) Notice: Subject to any disclaimer, the term of this patent is extended or adjusted under 35 U.S.C. 154(b) by 0 days.

(21) Appl. No.: 10/086,454

(22) Filed: Mar. 4, 2002

(65) Prior Publication Data

US 2002/0153066 A1 Oct. 24, 2002

(30) Foreign Application Priority Data

Mar. 2, 2001 (JP) ..... 2001-058993

(51) Int. Cl.[7] ..... H01F 1/047

(52) U.S. Cl. ..... 148/306; 148/315; 148/430; 148/442; 148/121; 420/82; 420/466; 420/581

(58) Field of Search ..... 148/306, 315, 148/430, 442, 120, 121, 122; 420/466, 82, 581

(56) References Cited

U.S. PATENT DOCUMENTS 4,814,027 A * 3/1989 Masumoto et al. ..... 148/300
5,190,599 A * 3/1993 Sahashi et al. ..... 148/315

FOREIGN PATENT DOCUMENTS

| | | | |
|---|---|---|---|
| DE | 3810678 A1 | | 11/1988 |
| JP | 63 146413 | | 6/1988 |
| JP | 63-146413 | * | 6/1988 |
| JP | 63-27027 | * | 11/1988 |
| JP | 63-272027 | * | 11/1988 |
| JP | 06 231956 | | 8/1994 |
| JP | 11-137576 | | 5/1999 |

OTHER PUBLICATIONS

O.A. Ivanov, et al., "Determination of the Anisotropy Constant and Saturation Magnetization, and Magnetic Properties of Powders of an Iron–Platinum Alloy", Phys. Met. Metallog., vol. 35, p. 81, 1973.

Osamu Okuno, et al, "Corrosion Resistance, Mechanical Properties and Attracive Force of Pt–Fe–Nb Magnets", Journal of the Japanese Society of Magnetic Applications in Dentistry, vol. 1, No. 1, p. 14, 1982.

T. Nakayama, et al., "Magnetic Properties of Hard Magnetic Fe–Pt Alloys in Dental Casts", Journal of the Magnetics Society of Japan, vol. 21, p. 377–380, 1997.

J.A. Aboaf, "Magnetic, transport, and Structural Properties of Iron–Platinum Thin Films", IEEE Transactions on Magnetics, vol. MAG–20, No. 5, p. 1642, 1984.

H. Aoyama, et al., "Dental Magnetic Attachment with Integrated Structure Utilizing Fe–Pt Magnet", Journal of the Magnetics Society of Japan, vol. 24, No. 4–2, p. 927, 2000.

(List continued on next page.)

*Primary Examiner*—John Sheehan
(74) *Attorney, Agent, or Firm*—Oblon, Spivak, McClelland, Maier & Neustadt, P.C.

(57) ABSTRACT

The present invention offers a minute-sized magnet with superior magnetic energy product $(BH)_{max}$ and coercivity iHc, as well as superior anti-corrosive properties. This magnet is comprised of an alloy comprised of 35–55 atomic % platinum, 0.001–10 atomic % third element, which is one or more elements from groups IVa, Va, IIIb, or IVb, and a remainder of iron and other unavoidable impurities. The average crystal size of this FePt alloy is 0.3 $\mu$m. By mixing an FePt alloy with a specific element in a designated ratio, an FePt magnet with more excellent characteristics than ones made from previous alloys was successfully made.

13 Claims, 2 Drawing Sheets

OTHER PUBLICATIONS

Kiyoshi Watanabe, et al., "On the High Energy Product of Fe–Pt Permanent Magnet Alloys", J. Japan Inst. Metals, vol. 47, No. 8, pp. 699–703, 1983.

H. Aoyama, et al., "Magnetic Properties of Fe–Pt Sputtered Thick Film Magnet", Journal of the Magnetics Society of Japan, vol. 20, No. 2, pp. 237–240, 1996.

Kiyoshi Watanabe, "Permanent Magnet Properties and Their Temperature Dependence in the Fe–Pt–Nb Alloy System," *Materials Transactions, JIM*, vol. 32, No. 3 (1991), pp. 292–298. XP–000866557.

H. Aoyama, et al., "Dental Magnetic Attachment with Integrated Structure Utilizing Fe–Pt Magnet", Journal of the Magnetics Society of Japan, vol. 24, No. 4–2, p. 927, 2000.

Kiyoshi Watanabe, et al., "On the High Energy Product of Fe–Pt Permanent Magnet Alloys", J. Japan Inst. Metals, vol. 47, No. 8, pp. 699–703, 1983.

H. Aoyama, et al., "Magnetic Properties of Fe–Pt Sputtered Thick Film Magnet", Journal of the Magnetics Society of Japan, vol. 20, No. 2, pp. 237–240, 1996.

* cited by examiner

Fe-Pt-Zr (32μm film) 0.5μm

Fe-Pt (32μm film) 0.5μm

FEPT MAGNET AND MANUFACTURING METHOD THEREOF

BACKGROUND OF THE INVENTION

The present invention concerns a FePt magnet and its manufacturing method. More concretely, the invention concerns a strong and small FePt magnet that has extremely good values of both of coercive force and maximum energy product, and its manufacturing method.

The Conventional Technique

In recent years, permanent magnets have been utilized not only in conventional motors, but also in medical devices that are used in a living body, such as dental magnetic attachments. For use in a living body, safety of the material is important. It is also required to demonstrate a strong magnetic force in the volume as small as possible in order to avoid burdening the living body.

In addition, research and development are being carried out for realization of so-called micro-machines. Micro-machines are expected to lead to a realization of medical treatment with fewer burdens on a living body. The development of a miniature, strong permanent magnet which has the size of not more than millimeter order and has high corrosion resistance, is required for the realization of a micro-machine.

Rare-earth magnets, of which NdFeB is representative, have been developed for and are currently widely used as high performance permanent magnets for motor and other common applications of magnets.

However, a rare-earth magnet can easily be oxidized as it has poor corrosion resistance, and as a result it cannot always be applied to the above-mentioned kinds of applications. For example, in medical devices that are used in a living body such as dental magnetic attachments, the direct use of a rare-earth magnet is difficult because of corrosion.

Consequently, in such cases, the use of a rare-earth magnet must be accompanied by complicated measures, such as a corrosion-resistant coating or containment of the magnet in a corrosion-resistant case, and it is not very easy to guarantee their corrosion resistance. In addition, such a coating sometimes brings resistance in the magnetic circuit, thereby preventing the original characteristics of the magnet from being exhibited. An example of measures against corrosion of a rare-earth magnet has been disclosed in Japanese laid-open patent publication number 11-137576.

Another demerit of a rare-earth magnet is that it is so fragile that it can easily be broken during processing, handling or use. For this reason, it is very difficult that rare-earth magnets are mechanical processed into minute, sub-millimeter sized parts, such as the above-mentioned micro-machines. Moreover, volumes of those minute parts are so small that even a small degree of oxidization on the surface can significantly effect their magnetic characteristics. Thus there are a number of problems in applying a rare-earth magnet to minute parts in terms of corrosion resistance.

On the other hand, a platinum alloy magnet such as CoPt or FePt is superior to a rare-earth magnet in terms of corrosion resistance and processing convenience. These alloys have excellent corrosion resistance, as they contain a large amount of platinum. Platinum alloy magnets also have excellent strength and toughness that lessen their chances of being broken.

FePt alloy is known to demonstrate especially good magnetic characteristics. A FePt alloy in an ordered phase demonstrates permanent magnetic characteristics, and has a CuAu ($L1_0$) type of face-centered tetragonal structure. The ordered phase can be obtained by employing the appropriate heat treatment to an alloy in an unordered phase (face-centered tetragonal structure, A-1 type). The FePt magnet mentioned above is known to have a degree of crystal magnetic anisotropy comparable to that of a rare-earth magnet (O. A. Ivanov et al, Phys. Met. Metallog. Vol. 35, p81, 1973) and is expected to have potentially very excellent magnetic characteristics.

A FePt alloy can demonstrate almost the same degree of corrosion resistance as platinum if it contains as much as 70 mass % platinum (Journal of the Japanese Society of Magnetic Applications in Dentistry, Vol. 1, No. 1, p. 14, 1982). Consequently, it is a suitable material especially for minute size magnets with high corrosion resistance.

However, these platinum alloy magnets have only achieved considerably lower magnetic characteristics compared to the rare-earth magnet.

For example, for dental use, manufacturing of FePt alloy parts by melt-cast method was attempted (Journal of the Magnetics Society of Japan, Vol. 21, p. 377–380, 1997). In the results of this study, value for maximum energy product $(BH)_{max}$ was reported to be 127.32 kJ/m$^3$ (16 MGOe; 1 GOe=79.5774×10$^{-4}$ J/m$^3$, conversion used throughout), and value for coercive force iHc was reported to be 318.30 kA/m (4 kOe:10Oe=79.5774 A/m, conversion used throughout), respectively. These are quite low compared to the magnetic characteristics of a rare-earth magnet.

A coercive force as low as 318.23 kA/m will become a serious problem when the alloy is manufactured into micro-sized parts, causing degradation in its magnetic characteristics, and yielding it unable to resist a demagnetizing field.

It has recently been reported that thin film FePt alloy demonstrates a remarkably high coercive force by means of sputtering.

The first report about thin film FePt alloy was by Aboaf (IEEE, Trans, MAG-20, p. 1642, 1984). According to this report, dependence of iHc on the composition was found, and the maximum iHc value for an equi-atomic FePt alloy was reported to be 843.52 kA/m (10.6 kOe). This report is noteworthy because it suggests that FePt might intrinsically possess good magnetic characteristics. Additionally, in terms of cost and simplicity of manufacturing miniature magnetic parts, for use in a micro-machine for example, a sputtering process, which is a film-growth process, is more desirable than a bulk process in which bulk material is mechanically processed to a predetermined size.

Aboaf's above-mentioned report concerns quite a thin film of 300–400 nm (3000–4000 Å), and it is necessary to make a thicker film in order for the alloy to be practical as a permanent magnetic part.

SUMMARY OF THE INVENTION

A Problem to Solve in the Invention

However, when the thickness of a film was increased in a sputtering process, a deterioration of the magnetic characteristics, especially in its coercive force, was found by one of the inventors (Journal of the Magnetics Society of Japan, Vol. 24, No. 4–2, p. 927, 2000). According to the report, the coercive force was measured as 716.20 kA/m (9 kOe) at a thickness around 0.5 $\mu$m, and decreased as the thickness of the film was increased, to not more than 397.89 kA/m (5 kOe) at a thickness of 100 $\mu$m. The decrease in coercive force was accompanied with a decrease of a maximum energy product from 127.32 kJ/m$^3$ (16 MGOe) to as low as 79.58 kJ/m$^3$ (10 MGOe). Thus it became apparent that a sputtering process, which had been thought to be efficient for an improvement in coercive force, was inefficient when the thickness of the film was increased to a practical range.

Because of the above evaluation, sufficient magnetic characteristics could not be achieved when miniature magnetic parts were manufactured from FePt alloy.

Sufficient magnetic characteristics are considered to be maximum energy product $(BH)_{max}$ values of not less than 159.15 kJ/m$^3$ (20 MGOe) and coercive force (iHc) values of not less than 557.04 kA/m (7 k Oe), for a relatively small film thickness of 1 $\mu$m. For film thickness of 30 $\mu$m, it is more desirable that values for maximum energy product $(BH)_{max}$ are not less than 119.37 kJ/m$^3$ (15 MGOe) and values for coercive force (iHc) are not less than 39 7.89 kA/m (5 koe) respectively, taking into account practical application to permanent magnetic parts.

Based on the circumstances stated above, the current invention is intended to provide an FePt alloy material that has good values for both maximum energy product and coercive force, and whose coercive force does not decrease with increased film thickness when manufactured by a film-growing process such as sputtering, thus allowing it to maintain a high maximum energy product.

Means to Resolve the Problem

Making a detailed study on a FePt alloy, the inventors found out that a small additive amount of a suitable third element to a FePt alloy would result in not only an improvement in its magnetic characteristics, but also an expression of a stable coercive force even with increased film-thickness leading to the ability to express a large maximum energy product even in a thick film state.

Although the reason is not completely clear why addition of a suitable third element to a FePt alloy brings about an improvement in its magnetic characteristics, through the discovery of a close relationship between coercive force and crystal particle size, the inventors consider that addition of the third element brings about a reduction in the crystal particle size, leading to an improvement in the magnetic characteristics. The following is an explanation how the invention has come to be made.

For bulk state FePt binary alloy manufactured by melting and casting and then heat treatment, the influence of the composition and heat treatment has been investigated and it has been found that the alloy displays maximum values in both coercive force and maximum energy product when it is composed of 3 8.5 atomic % Pt-Fe. However, as mentioned above, the coercive force is at most 318.31 kA/m (4 kOe), which is quite low. The crystal particle size is in the hundreds of $\mu$m.

On the other hand, the crystal particle size of a sputtered FePt alloy film that has a high coercive force has been reported to be about 0.05–0.2 $\mu$m. It can therefore be presumed that crystal particle size has a great influence on coercive force.

From results of an investigation of a relationship between film-thickness of a FePt alloy made by sputtering and crystal particle size, the inventors found that crystal particle size increases with increased film thickness and concluded that a decrease in coercive force is caused by the increased crystal particle size.

Addition of a small amount of a third element other than Fe and Pt was attempted as a means to inhibit an increase in crystal particle size, and from the results of repeated tests it turned out that an addition of one or more elements selected from the group consisting of IVa, Va, IIIb, and IVb elements (IUPAC) is effective.

Among the elements stated above, an addition of one or more elements selected from the group consisting of C, B, Si, Al, Ti and Zr is even more effective.

The addition of a single or compound addition of these elements inhibits crystal particle growth, bringing about an excellent coercive force. A stable coercive force enables a high maximum energy product to be expressed.

The inventors also found out that for film thickness ranging up to 100 $\mu$m, the average crystal particle size that satisfies values for coercive force (iHc) of not less than 397.89 kA/m (5 kOe) and values for maximum energy product $(BH)_{max}$ of not less than 119.37 kJ/m$^3$ (15 MGOe), respectively, was not more than 0.3 $\mu$m. The smaller crystal particle size is, the higher the coercive force and maximum energy product that can be achieved. Crystal particle size should ideally be not more than 0.1 $\mu$m, and more desirably, not more than 0.05 $\mu$m.

BRIEF DESCRIPTION OF THE DRAWINGS

Simple Explanations for Figures

DETAILED DESCRIPTION OF THE PREFERRED EMBODIMENT

Applied Forms of the Invention

The FePt Magnet

Figure 1:
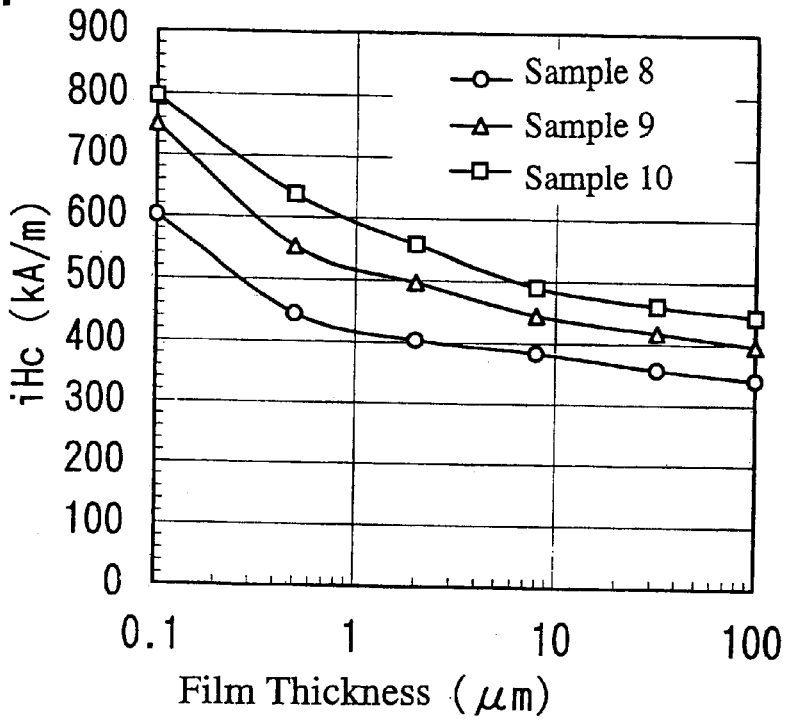
FIG. 1 Dependence of iHc on film thickness for each sample in Example 2.

The magnets in the applied forms of the invention are FePt alloy permanent magnets that are composed of 30–48% of platinum, 0.5–10% of one or more kinds of the third elements selected from the group consisting of IVa, Va, IIIb and IVb elements and a remainder of iron and some unavoidable impurities. These alloys are favorable as they can achieve a CuAu ($L1_0$) type face-centered tetragonal crystal structure, and thus a high degree of crystal magnetic anisotropy. In addition, it can be molded into minute magnets in its film state, so its applied fields are expected to spread to such applications as micro-machines. In these cases, film thickness of not less than 0.1 $\mu$m and of not more than 500 $\mu$m is desirable. The FePt magnets in the current invention maintain sufficient magnetic characteristics in such a thin film state.

The reason the composition of Pt as a main component was modulated within 35–55 atomic % is that, a Pt composition of not less than 35% improves the coercive force, and a Pt composition of not more than 55%, resulting in a relatively high Fe composition, improves magnetization, bringing the maximum energy product. It is especially desirable that the Pt composition be modulated between 38–48%.

The reason the third element, that can be one or more elements, desirably one or two elements selected from the group consisting of IVa, Va, IIIb and IVb elements, was added in an amount of 0.001–10 atomic % is that additive composition of not less than 0.001% has an inhibitory effect on crystal particle growth, and additive composition of not more than 10% improves the magnetic characteristics. In addition, the addition of C, B, Si, Al, Ti or Zr is more desirable for these effects.

By way of these additive elements, it becomes possible to limit average crystal particle diameter to not more than 0.3 $\mu$m. The smaller crystal particle size is, the more coercive force and maximum energy product will be improved. It is preferred that the size be smaller than 0.1 $\mu$m, and it is especially desirably for it to be smaller than 0.05 $\mu$m.

As for magnetic characteristics, a magnet whose maximum energy product $(BH)_{max}$ is not less than 119.37 kJ/m$^3$ (15 MGOe) and whose coercive force iHc is not less than 397.89 kA/m (5 kOe), respectively, would be most desirable, considering application in micro-machines.

A Manufacturing Method of the FePt Magnet

The manufacturing method for the applied form is one by which the FePt magnet stated above can be favorably manufactured. A detailed explanation was omitted as the suitable constituent elements and their ratio should be the same as the above-mentioned FePt magnet.

The method is the one that produces a FePt magnet through a film-forming process and a heat-treatment process. A film-forming process is a process in which an alloy film of the fixed composition is obtained by either a sputtering process or a vacuum-deposition process. By employing these film-forming processes, the above-mentioned FePt magnet of favorable film-thickness ranging from 0.1 $\mu$m to approximately 500 $\mu$m can be manufactured efficiently.

The FePt magnet can easily be made into any desired shape through patterning and can also be integrated with other parts. Moreover, outstanding batch productivity can be realized, as it is possible to form a film on a large area. By employing these thin-film forming processes and applying techniques such as semi-conductor lithography, mass production of minute parts becomes possible.

For a sputtering or vacuum deposition, any commonly known method can be applied. A FePt magnet of any desired composition can be achieved by, for example, producing a film due to sputtering or vacuum deposition using an alloy of FePt and a third element mixed in a fixed ratio; vacuum deposition or sputtering using each of the independently prepared single substances applied in turn or alternately; or vacuum deposition or sputtering of a third element onto a FePt alloy that is already blended in a fixed composition to make them into an alloy.

In theses methods, by employing heat treatment to the prepared film through vacuum deposition or sputtering, the crystal structure of the FePt magnet is made to be CuAu ($L1_0$) type face-centered tetragonal, resulting in an improvement in the magnetic characteristics. Temperature and atmospheric conditions for heat treatment vary with the composition of the FePt magnet, and should ideally be between 300–800° C. under vacuum or an inactive gas atmosphere.

Examples of Applied Forms

EXAMPLE 1

Sample Preparation

The FePt magnetic film having the structure of $Fe_{58}Pt_{42}$ Mx was formed by a direct-current Magnetron sputtering method.

A binary alloy of $Fe_{58}Pt_{42}$ was used as a target, and a pure chip of an additive element was placed on top of the target. The kind of third element was changed by applying a series of C, B, Si, Al, Ti, Zr and Nb chips. The additive amount of the third element (=M) is presented in Table 1. The thickness of the films were set to be 0.5 $\mu$m.

For a substrate, a silicone wafer with an oxidized film was used.

For sputtering conditions, maximum vacuum pressure was not more than $1.3\times10^{-5}$ Pa ($1.0\times10^{-6}$ Torr), argon gas pressure during film formation was 65 mPa (5 mTorr) and electric power input was 0.3 kW. The films were formed at room temperature. After the films were formed, the substrate was removed, cut into 6 mm squares and then heat-treated under vacuum at the conditions shown in Table 1 (600–8000° C., 2 hours). Finally, magnetic characteristics were measured.

Results

Maximum energy products of each alloy are indicated in Table 1.

The $(BH)_{max}$ of the binary FePt magnet was determined to be 1 15.79 kJ/m$^3$ (14.55 MGOe), whereas the magnets with additive of C, B, Si, Al, Ti, Zr or Nb showed higher $(BH)_{max}$ values than the one of the binary FePt magnet, exceeding 119.37 kJ/m$^3$ (15 MGOe).

In particular, sample 6, to which Zr was added, achieved more than 40% improvement in its $(BH)_{max}$ value, resulting in excellent characteristics. Different heat treatment temperatures were employed for different additive elements because different additive elements have different transformation temperatures at which the phase transformation from an unordered phase to an ordered phase occurs. Consequently, in these examples, the most suitable heat treatment conditions were adopted for each additive element. In all of samples 1–7, the average crystal particle sizes were relatively small, ranging from 0.02–0.03 $\mu$m. Crystal particle sizes were determined in the following manner. The average crystal particle length was defined as the average of the longest and shortest diameters. Then, the crystal particle size was calculated by averaging all of the average crystal particle sizes in five viewing fields each 1 $\mu$m square.

In conclusion, the FePt magnet in these examples that include C, B, Si, Al, Ti, Zr or Nb possesses an excellent maximum energy product that is quite useful in application to minute medical devices and micro-machines.

TABLE 1

| Sample No. | Additive Element | x | Flim Thickness $\mu$m | Treatment Conditions | (BH)max kJ/m3 (MGOe) | iHC kA/m (kOe) | Average Particle Size $\mu$m |
|---|---|---|---|---|---|---|---|
| 1 | no additive | 0 | 0.5 | 600° C., 2 hours | 115.48 (14.55) | 420.63 (5.30) | 0.03 |
| 2 | B | 3.5 | 0.5 | 600° C., 2 hours | 136.11 (17.15) | 507.94 (6.40) | 0.03 |
| 3 | C | 2.8 | 0.5 | 600° C., 2 hours | 119.21 (15.02) | 523.81 (6.60) | 0.03 |
| 4 | Al | 0.9 | 0.5 | 800° C., 2 hours | 134.52 (16.95) | 484.13 (6.10) | 0.02 |
| 5 | Si | 5 | 0.5 | 600° C., 2 hours | 127.38 (16.05) | 507.94 (6.40) | 0.03 |
| 6 | Zr | 0.4 | 0.5 | 660° C., 2 hours | 166.98 (21.04) | 523.81 (6.60) | 0.02 |
| 7 | Nb | 0.3 | 0.5 | 700° C., 2 hours | 135.08 (17.02) | 507.94 (6.40) | 0.02 |

EXAMPLE 2

In an Example 2, magnetic characteristics and crystal particle sizes were investigated with changing film thickness for each of a binary FePt alloy magnet (sample 8), a Zr additive sample (sample 9) and a composite additive of Zr and B sample (sample 10).

An alloy target with a composition of $Fe_{58}Pt_{42}$ (sample 8), an alloy target with a composition of $Fe_{58}Pt_{41.4}Zr_{0.6}$ (sample 9) and an alloy target with a composition of $Fe_{58}Pt_{40.4}Zr_{0.6}B_{1.0}$ (sample 10) were used as sputtering targets.

Altering the sputtering time changed the thickness of the film. Heat treatment was performed at 660° C. for two hours under vacuum.

Other conditions were the same as those in Example 1.

Results

Figure 2:
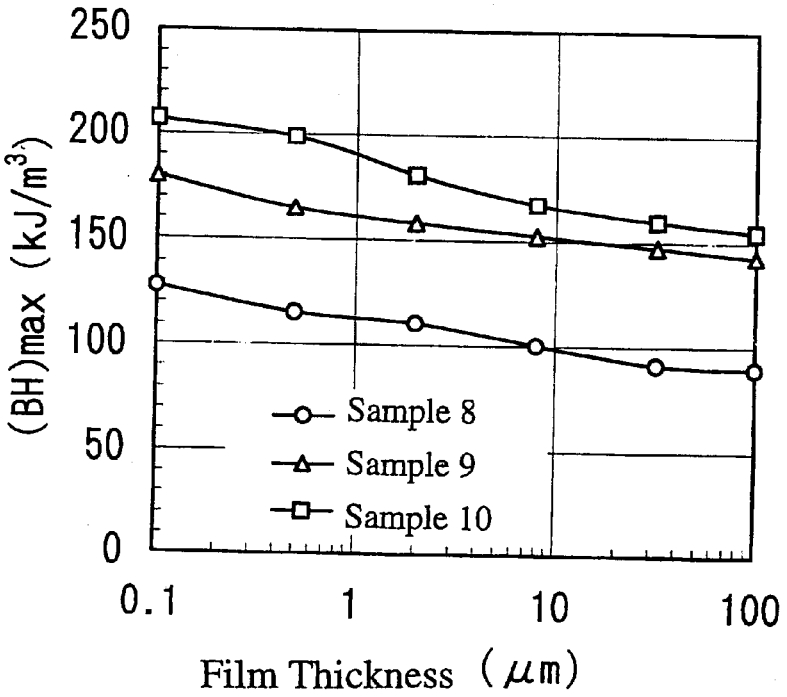
FIG. 2 Dependence of $(BH)_{max}$ on film thickness for each sample in Example 2.

The measured magnetic characteristics of each sample are shown in FIG. 1 and FIG. 2.

With increased film thickness, coercive force in any of alloys tends to decrease. Accordingly, maximum energy products of the alloys also decrease. However, samples 9 and 10 always show more excellent magnetic characteristics than samples of binary alloy. In sample 8, when the thickness of film reaches 0. 5 μm, the $(BH)_{max}$ value was decreased to not more than 119.37 kJ/m$^3$ (15 MGOe), whereas the Zr-B composite additive alloy (sample 10) exhibited relatively high $(BH)_{max}$ values, namely, values of 15 9.15 kJ/m$^3$ (20 MGOe) even at 32 μm and the Zr only additive alloy (sample 9) exhibited 142.24 kJ/m$^3$ (18 MGOe), respectively. These values are high enough for this permanent magnetic material to be applied to various uses.

At 100 μm film thickness, both iHc and $(BH)_{max}$ values were significantly decreased. Samples 9 and 10 exhibited iHc values higher than 397.89 kA/m as well as $(BH)_{max}$ values higher than 119.3 7 kJ/m$^3$ at 100 μm thickness. On the other hand, sample 8 showed an iHc value lower than 397.89 kA/m at 3 μm thickness as well as a $(BH)_{max}$ value lower than 119.37 kJ/m$^3$ at 0.5 μm thickness.

Figure 3:
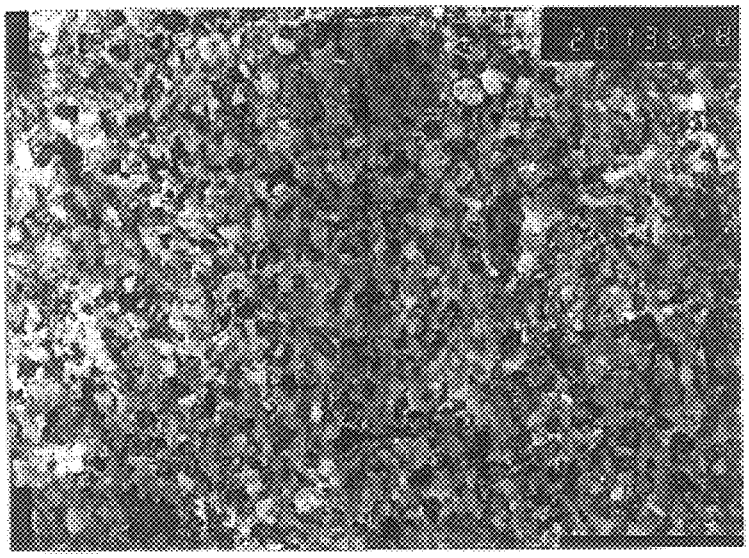
FIG. 3 A TEM image of sample 9 in Example 2.
Figure 4:
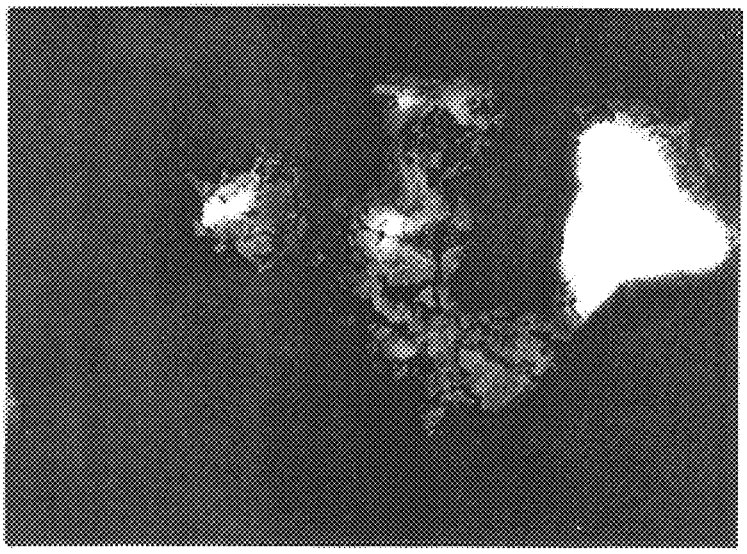
FIG. 4 A TEM image of sample 8 in Example 2.

Transmission electron microscopy images for 32 μm-thick film materials in these examples are shown in FIG. 3 (sample 9) and FIG. 4 (sample 8). In sample 8, the crystal particles have grown as large as 0.5 μm, while sample 9 has relatively minute crystals smaller than 0.1 μm. This indicates that additive elements have the effect of reducing crystal particle size.

Effects of the Invention

In conclusion, the FePt magnets in the current invention that contain more than one kind of third element selected from the group consisting of IVa metallic elements, Va metallic elements, IIIb semi-metal and semi-conductor elements and IVb semi-metal and semi-conductor elements, possesses an excellent maximum energy product, resulting in an increased applicability to minute parts such as those for medical use or micro-machines.

What is claimed is:

1. A FePt magnet made of an alloy comprising

35–55 atomic % platinum;

0.001–10 atomic % of one or more additional elements selected from the group consisting of IVa, Va, IIIb and IVb elements;

iron; and unavoidable impurities, wherein the alloy has an average crystal grain size of not more than 0.3 μm;

the alloy has a CuAu ($L1_0$) face-centered tetragonal crystal structure;

the magnet is a film between 0.1 μm and 500 μm thick; and the additional elements are one or more of elements selected from the group consisting of C, Si, Al and Zr.

2. The FePt magnet described in claim 1, wherein the magnet has a maximum energy product $(BH)_{max}$ of not less than 119.37 kJ/m$^3$ (15 MGOe); and a coercive force iHc of not less than 397.89 kA/m (5kOe).

3. A method of manufacturing a FePt magnet made of an alloy comprising

35–55 atomic % platinum;

0.001–10 atomic % of one or more additional elements selected from the group consisting of IVa, Va, IIIb and IVb elements;

iron; and unavoidable impurities, the method including a film-forming step in which the alloy is deposited as a film using a sputtering or a vacuum deposition method; and a heat-treatment step in which the alloy is heat treated so as to have a CuAu ($L1_0$) face-centered tetragonal crystal structure.

4. A FePt magnet made of an alloy comprising

35–55 atomic % platinum;

0.001–10 atomic % of one or more additional elements selected from the group consisting of IVa, Va, IIIb and IVb elements;

iron; and unavoidable impurities, wherein the alloy has an average crystal grain size of not more than 0.3 μm;

the alloy has a CuAu ($L1_0$) face-centered tetragonal crystal structure;

the magnet is a film between 0.1 μm and 500 μm thick; and the one or more additional elements are selected from the group consisting of IVa elements, V, Ta, Al, Ga, In, TI, and IVb elements.

5. A FePt magnet made of an alloy comprising

35–55 atomic % platinum;

0.001–10 atomic % of one or more additional elements selected from the group consisting of IVa, Va, IIIb and IVb elements;

iron; and unavoidable impurities, wherein the alloy has an average crystal grain size of not more than 0.3 μm;

alloy has a CuAu ($L1_0$)face-centered tetragonal crystal structure;

the magnet is a film between 0.1 μm and 500 μm thick; and the one or more additional elements are selected from the group consisting of IVa elements.

6. A FePt magnet made of an alloy comprising

35–55 atomic % platinum;

0.001–10 atomic % of one or more additional elements selected from the group consisting of IVa, Va, IIIb and IVb elements;

iron; and unavoidable impurities, wherein the alloy has an average crystal grain size of not more than 0.3 μm;

the alloy has a CuAu ($L1_0$) face-centered tetragonal crystal structure;

the magnet is a film between 0.1 μm and 500 μm thick; and the one or more additional elements is Zr.

7. A FePt magnet made of an alloy comprising

35–55 atomic % platinum;

0.001–10 atomic % of one or more additional elements selected from the group consisting of IVa, Va, IIIb and IVb elements;

iron; and unavoidable impurities, wherein the alloy has an average crystal grain size of not more than 0.3 μm;

the alloy has a CuAu ($L1_0$) face-centered tetragonal crystal structure;

the magnet is a film between 0.1 $\mu$m and 500 $\mu$m thick; and the one or more additional elements include at least one element selected from the group consisting of IVa elements, and at least one element selected from the group consisting of IIIb elements.

8. A FePt magnet made of an alloy comprising

35–55 atomic % platinum;

0.001–10 atomic % of one or more additional elements selected from the group consisting of IVa, Va, IIIb and IVb elements;

iron; and unavoidable impurities, wherein the alloy has an average crystal grain size of not more than 0.3 $\mu$m;

the alloy has a CuAu ($L1_0$) face-centered tetragonal crystal structure;

the magnet is a film between 0.1 $\mu$m and 500 $\mu$m thick; and the one or more additional elements include Zr and B.

9. The FePt magnet described in claim 4, wherein the average crystal grain size of the alloy is not more than 0.03 $\mu$m.

10. The FePt magnet described in claim 5, wherein the magnet has a maximum energy product $(BH)_{max}$ of not less than 119.37 kJ/m$^3$ (15 MGOe); and a coercive force iHc of not less than 397.89 kA/m (5kOe).

11. A method of manufacturing a FePt magnet made of an alloy comprising

35–55 atomic % platinum;

0.001–10 atomic % of one or more additional elements selected from the group consisting of IVa, Va, IIIb and IVb elements;

iron; and unavoidable impurities, where the alloy has an average crystal grain size of not more than 0.3 $\mu$m;

the alloy has a CuAu ($L1_0$) face-centered tetragonal crystal structure; and the magnet is a film between 0.1 $\mu$m and 500 $\mu$m thick, the method including a film-forming step in which the alloy is deposited as the film using a sputtering or a vacuum deposition method; and a heat-treatment step in which the alloy is heat treated so as to have the CuAu ($L1_0$) face-centered tetragonal crystal structure.

12. The FePt magnet described in claim 4, wherein the magnet has a maximum energy product $(BH)_{max}$ of not less than 119.37 kJ/m$^3$ (15 MGOe); and a coercive force iHc of not less than 397.89 kA/m (5kOe).

13. The FePt magnet described in claim 7, wherein the magnet has a maximum energy product $(BH)_{max}$ of not less than 119.37 kJ/m$^3$ (15 MGOe); and a coercive force iHc of not less than 397.89 kA/m (5kOe).

* * * * *